US005216822A

United States Patent [19]

Madiedo

[11] Patent Number: 5,216,822

[45] Date of Patent: Jun. 8, 1993

[54] BLOW DRYER AIR FILTER

[76] Inventor: Silvia Madiedo, 335 Laurie Rd., West Palm Beach, Fla. 33405

[21] Appl. No.: 878,583

[22] Filed: May 5, 1992

[51] Int. Cl.[5] ..... F26B 21/06

[52] U.S. Cl. ..... 34/82; 34/97; 55/385.1; 392/385

[58] Field of Search ..... 34/96, 97, 98, 82; 4/536, 537; 392/385; 55/385.1

[56] References Cited

U.S. PATENT DOCUMENTS

| | | | |
|---|---|---|---|
| 2,041,687 | 5/1936 | Benson | 417/423 |
| 3,857,016 | 12/1974 | Meyer et al. | 34/97 |
| 4,254,324 | 3/1981 | Vrtaric | 34/98 |
| 4,308,670 | 1/1982 | Bonnema | 34/97 |
| 4,634,839 | 1/1987 | Gilbertson | 34/97 |
| 4,683,369 | 7/1987 | Rieckman et al. | 34/96 |
| 4,794,225 | 12/1988 | Maese | 219/370 |
| 4,835,879 | 6/1989 | Egelstad | 34/97 |
| 4,848,007 | 7/1989 | Montagnino | 34/97 |
| 4,939,345 | 7/1990 | Farina et al. | 34/97 |
| 4,955,145 | 9/1990 | Scivoletto | 34/97 |
| 5,013,891 | 5/1991 | Shoemaker | 219/385 |
| 5,112,374 | 5/1992 | Ackerman | 34/82 |

*Primary Examiner*—Henry A. Bennett
*Assistant Examiner*—Denise Gromada
*Attorney, Agent, or Firm*—Quarles & Brady

[57] ABSTRACT

A filtering system for inhibiting the intake of clogging material into the air inlet of a portable blow dryer includes a filter and a fastener, such as straps, connected to the filter for positioning the filter over the air inlet of the blow dryer in a removable fashion. The straps can be elastic to stretch during mounting and retract to snugly secure the filter to the air inlet openings. A pair of opposing filters can be interconnected by the straps for filtering air to dual lateral air inlets, or the filtering straps can be connected to a ring for mounting to a rear axial air inlet.

13 Claims, 2 Drawing Sheets

BLOW DRYER AIR FILTER

FIELD OF THE INVENTION

The invention relates generally to air filters and more particularly to air filters for blow dryers.

BACKGROUND OF THE INVENTION

A hand-held hair dryer, commonly referred to as a blow dryer, typically has a screen or other filter element incorporated within its housing to filter air drawn into the fan intake of the housing. While conventional screens are generally capable of preventing large foreign objects from entering and ensnarling the dryer fan blades, the screens are generally inadequate to prevent the accumulation of dust and dirt in the interior of the blow dryer that ultimately affects the dryer's performance and its breakdown.

The damaging collection of dirt and debris in a blow dryer interior is particularly frequent and acute in professional hair styling salons. The high concentrations of hair spray, talc powder and other hair treatments in the salon air combine with dust, dirt and airborne hair particles to form a sticky, clogging material. Under extensive and continuous use by a hair stylist, the blow dryer can become clogged with the sticky debris to the point of diminished performance or complete inoperability within a few days or a week.

The clogging material progressively and substantially restricts drying air flow, thereby requiring longer periods of time to style wet or damp hair. Unless the blow dryer is regularly cleaned through a difficult dismantling process or by cumbersome cleaning through the screen, the blow dryer will often breakdown due to motor burnout or premature overheating.

SUMMARY OF THE INVENTION

It is an object of the invention to provide a blow dryer filtering system that significantly inhibits the intake of clogging material into the internal components of a blow dryer.

It is another object of the invention to provide a blow dryer filtering system that is simple and inexpensive to construct.

It is a further object of the invention to provide a blow dryer filtering system that is adjustable to accommodate different size blow dryers.

It is a still further object of the invention to provide a filtering system for a blow dryer that is easily removable and cleanable, or alternatively, disposable.

These and other objects of the invention are provided by a blow dryer filtering system including an external mountable filter and a fastener connected to the filter for removably positioning the filter in at least a portion of the intake air flow of the blow dryer air inlet. The removable filter captures clogging material, such as hair spray coated particles, and can be readily removed for cleaning or for disposal and replacement.

The fastener can include a series of straps extending from the filter to a back support member that mounts to an opposing side of the blow dryer housing. The straps can be constructed of elastic material to stretch during mounting and then retract for a snug fit around the dryer housing. Alternatively, the straps can be made of relatively unstretchable material, such as plastic or leather, and include a series of adjustable buckles for adjustably mounting to the dryer housing.

The back support member can be formed as a simple support plate, or the back support member can be formed as a second filter for a second air inlet. In some blow dryer constructions, the air inlet is located on a rear portion of the barrel of a gun-shaped dryer, axially opposed to the barrel outlet of the dryer. To securely position the filter on this type dryer, the back support member can be formed as a ring for surrounding a periphery of the dryer barrel and engaging the dryer handle to support the filter and associated straps.

The filter can be formed by different media. Preferably, the filter is constructed of a filter media which is sufficiently dense to capture clogging material while allowing liberal air flow. The filter can also be adjustable by comprising two over-laid mesh screens which are angularly adjustable to control the size of the screen apertures. The filter media can be selected for reusability or for inexpensive disposability. An alternative embodiment also includes a disposable filter insert in a permanent support ring.

The thus described filtering system substantially enhances the performance and longevity of a standard blow dryer and minimizes the time and expense associated with blow dryer maintenance. The adjustable fastener possibilities make the filter essentially universally applicable, and the simple construction allows simple and cost effective manufacture.

BRIEF DESCRIPTION OF THE DRAWINGS

A more detailed understanding of the invention can be gained from a reading of the following detailed description in association with the accompanying drawings, in which.

DETAILED DESCRIPTION OF THE PREFERRED EMBODIMENTS

Figure 1:
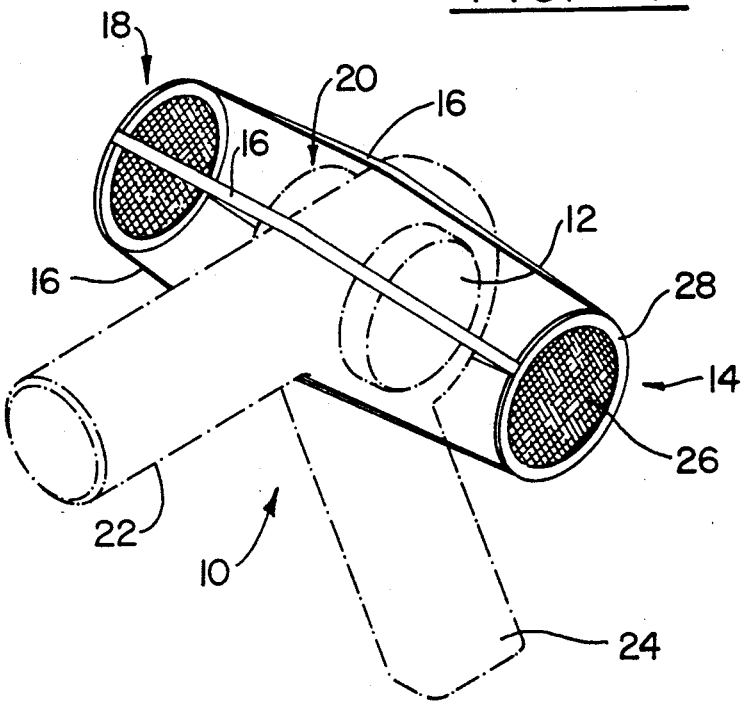
FIG. 1 shows an embodiment of the filtering system of the invention in a stretched, mounting configuration around a conventional blow dryer.

Referring to the drawings, the invention is generally directed to a filtering system for inhibiting the intake of clogging material into the air inlet of a portable blow dryer wherein the filtering system can be readily removed for cleaning or for disposable and replacement. The filtering system generally includes a filter for filtering air drawn into the inlet of the blow dryer and a fastener for removably positioning the filter in at least a portion of the air flow of the blow dryer air inlet.

Referring to FIG. 1, a preferred embodiment of the filtering system for use with a conventional hair dryer 10 having at least one laterally positioned air inlet 12 includes a filter member 14 positioned in the air flow of the air inlet 12 by a fastener, such as a series of elastic straps 16 extending from the filter member 14 to a back support member 18, to be positioned on an opposite lateral side 20 of the blow dryer 10. The elastic straps 16 are capable of stretching, as shown, to be manipulated around the exhaust barrel 22 and handle 24 of the blow dryer 10. When the filter member 14 and back support member 18 are generally aligned with the air inlet 12 of the dryer 10, the elastic straps 16 are returned to their original length to snugly position the filter member 14 and back support member 18 adjacent the air inlet 12 and opposite side 20 of the blow dryer 10.

The filter member 14 preferably includes a filtering media, such as a mesh screen 26 having a peripheral support ring 28. The support ring 28 can be constructed of a textile material, and the screen mesh 26 can be sewn to this material in a reinforced manner. The elastic straps 16 can be secured to the support ring 28 or can further extend for connection directly to peripheral edges of the screen mesh 26. The filter member 14 preferably has a generally circular shape to correspond to the generally circular shape of a conventional air inlet 12; however, the filter member 14 and its components can have other shapes.

The back support member 18 can be formed as a solid plate for providing support to the straps 16 and filter member against the opposite side 20 of the blow dryer 10. As shown in FIG. 1, the back support plate 18 preferably can be formed from reinforced screen mesh and thereby function as a second filter member for use on a blow dryer having dual air inlets on opposing lateral sides of the blow dryer. The construction of the back support member 18 element can be the same as the construction of the filter member 14 if back support member 18 is to function as a second filter member. As an alternative embodiment, the fastener can include straps extending in loop fashion without a back plate to the opposite side of the blow dryer although the ability to hold the back support member 18 and the filter member 14 simultaneously to stretch the straps 16 can make the mounting process easier.

Figure 2:
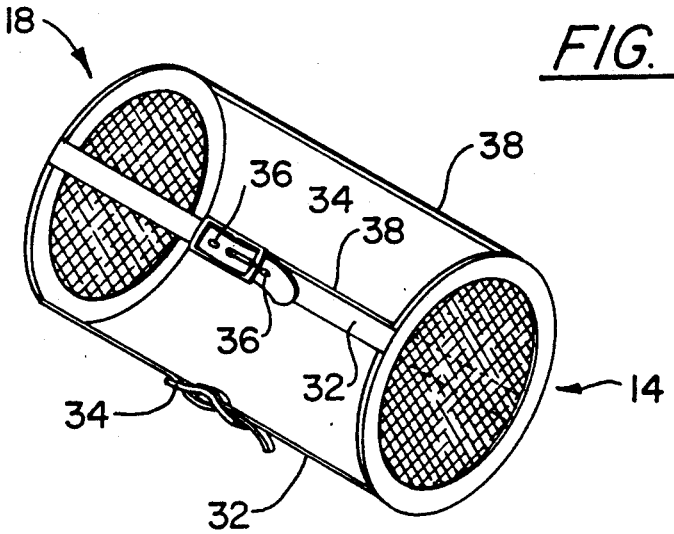
FIG. 2 shows an alternative embodiment of the filtering system.

Referring to FIG. 2, the fastener can include relatively non-stretchable straps 32 made from plastic leather or the like. To provide adjustability and ease of mounting, the non-stretchable straps 32 can have buckles 34 for engaging, a plurality of strap holes. In embodiments having four straps, two rearwardly directed straps 38 can be uninterrupted and the forward straps 32 can provide the buckles for positioning around the barrel 22 and handle 24 of the blow dryer 10 (see FIG. 1). The straps 32, 38 can be adjustably secured by hook-and-loop fasteners to either connect to strap portion or to attach the straps to the body of the dryer 10.

Figure 3:
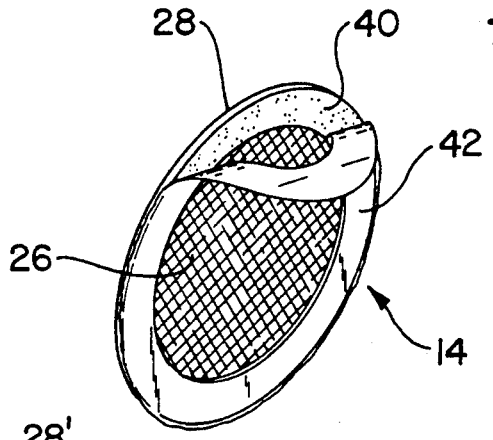
FIG. 3 shows another alternative embodiment of the filtering system of the invention.

Referring to FIG. 3, the filtering device can include an adhesive 40 as the fastener for the filter member 14. The adhesive 40 can be applied to the support ring 28 for connection to a peripheral surface of the blow dryer air inlet 12. During storage, the adhesive 40 can be protected by a peelable cover 42 to prevent inadvertent sticking prior to use.

Figure 4:
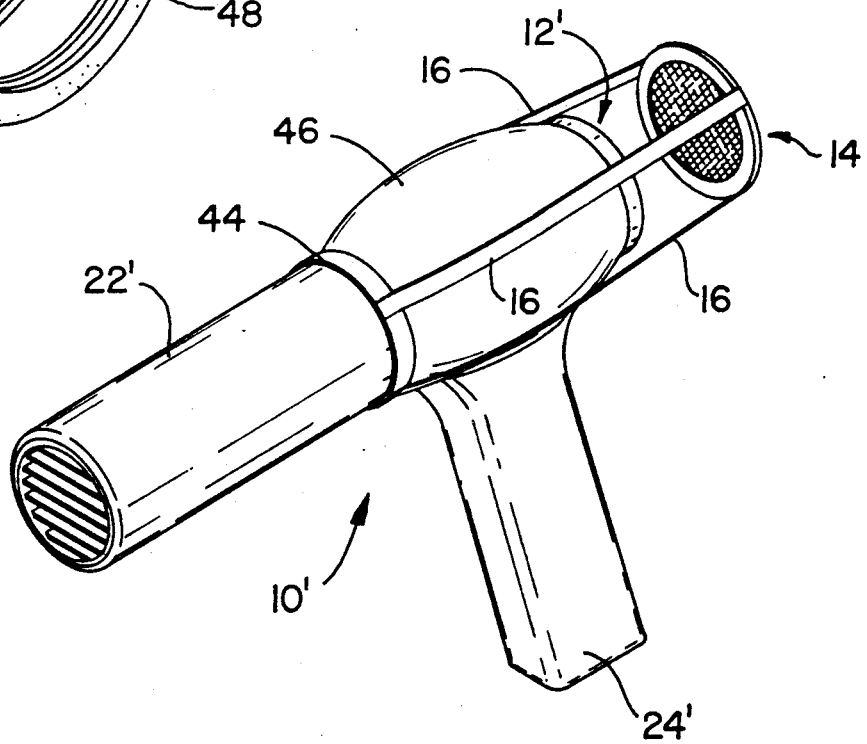
FIG. 4 shows a fourth alternative embodiment of the filtering system of the invention for mounting to a blow dryer having an axially rear positioned air inlet.

Referring to FIG. 4, some blow dryers 10' are constructed to draw air into an air inlet 12' situated on an axially rear position of the dryer barrel 22'. The fastener of the filtering system can be constructed to mount the filter to this rearwardly directed air inlet 12'. As shown in stretched position, the preferred elastic straps 16 of the filtering system extend from the filter member 14 to a support member 44 formed as a ring for circumferentially mounting on the barrel 22, of the blow dryer 10'. The support member 44 engages a forward portion of a handle 24' or an enlarged surface 46 of the barrel 22' to securely support the straps 16 and filter member 14. When the filter member 14 is released, the elastic straps 16 return to their original unstretched position, snugly positioning the filter member 14 over the rear air inlet 12'.

The filter media can be formed of different materials. Preferably, the filter is constructed of a material which is sufficiently dense to capture clogging material while allowing liberal air flow. The filter can be made of fine mesh screen, with perhaps 0.5 mm apertures. The filter can be adjustable by including at least two over laid mesh screens which are angularly adjustable relative to each other to control the size of the screen apertures formed.

Figure 5:
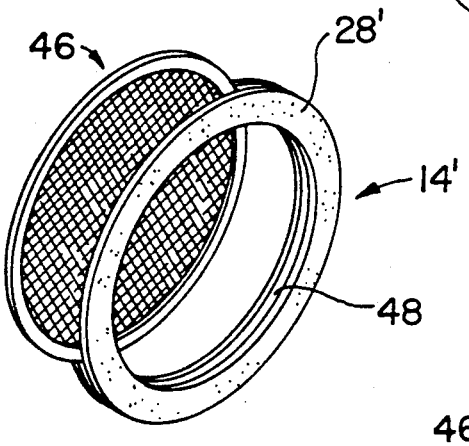
FIG. 5 shows a fifth embodiment in which filter inserts are removably loaded in a support ring.

Referring to FIG. 5, the filter member 14' can include over laid screens 46 inserted into a permanent support ring 28' having a slot 48 for receiving the screen inserts 46. In simple fashion, the screens 46 can be manipulated by simultaneously inwardly pressing on both screens 46 and twisting to obtain the desired relative angular positioning. The permanent support 28' and filter inserts 46 can also be used in embodiments in which the filter insert 46 are made of a disposable filter material. Alternatively, the filter screens 46 can be constructed to be easily cleaned and reused. The screens 46 can be constructed of other filtering materials such as foam and fiber based filter media.

The described filtering system provides a simple and inexpensive means for improving the performance of a standard blow dryer and minimizing blow dryer maintenance. As various detailed features of the preferred embodiments have been set forth, additional alternatives and modifications within the scope of the invention will likely be apparent to those skilled in the art after a review of the disclosure. Accordingly, the scope of the invention should not be determined by the above description, but rather by a reasonable interpretation of the following claims.

I claim

1. A filtering system for inhibiting the intake of clogging material into the air inlet of a portable blow dryer, said filtering device comprising:

an externally mountable filter and a fastener connected to the filter for removably positioning the filter in at least a portion of the intake air flow of the blow dryer air inlet, wherein the fastener includes a plurality of straps extending from the filter to a back support member, said back support member being mountable to a side of the blow dryer housing opposed to the air inlet for securing the position of the filter when mounted.

2. The filtering system according to claim 1, wherein the straps are adjustable.

3. The filtering system according to claim 2, wherein the straps include adjustable buckles.

4. The filtering system according to claim 2, wherein the straps are elastically stretchable.

5. A filtering system for inhibiting the intake of clogging material into the air inlet of a portable blow dryer, said filtering device comprising:

an externally mountable filter and a fastener connected to the filter for removably positioning the filter in at least a portion of the intake air flow of the blow dryer air inlet wherein the straps are adjustable and, the back support member is a ring, whereby said ring can peripherally surround a barrel of the blow dryer and engage the handle of the blow dryer to support the positioning of the filter on a rear air inlet axially disposed at the end of the barrel.

6. The filtering system according to claim 2, wherein the back support member includes a second filter for inhibiting the intake of clogging material into a second air inlet of the portable blow dryer.

7. The filtering system according to claim 1, wherein the filter includes a mesh screen.

8. The filtering system according to claim 7, wherein the mesh screen has apertures approximately 0.5 mm square.

9. The filtering system according to claim 1, wherein the filter includes at least two mesh screens, overlaid angularly.

10. The filtering system according to claim 9, wherein the at least two screens are adjustable angularly relative to one another.

11. The filtering system according to claim 1, wherein the filter is cleanable and reusable.

12. The filtering system according to claim 1, wherein the filter is disposable.

13. The filtering system according to claim 1, wherein the filter includes a filtering insert removably connected to a support rim.

* * * * *